US009770640B1

(12) United States Patent
Kurz

(10) Patent No.: US 9,770,640 B1
(45) Date of Patent: Sep. 26, 2017

(54) NET DEPLOYMENT SYSTEM

(71) Applicant: Donald Reed Kurz, Lynden, WA (US)

(72) Inventor: Donald Reed Kurz, Lynden, WA (US)

( * ) Notice: Subject to any disclaimer, the term of this patent is extended or adjusted under 35 U.S.C. 154(b) by 125 days.

(21) Appl. No.: 14/838,185

(22) Filed: Aug. 27, 2015

Related U.S. Application Data

(60) Provisional application No. 62/043,165, filed on Aug. 28, 2014.

(51) Int. Cl.
*A63B 71/04* (2006.01)
*A63B 71/02* (2006.01)

(52) U.S. Cl.
CPC ..... *A63B 71/022* (2013.01); *A63B 71/04* (2013.01)

(58) Field of Classification Search
CPC ..... A63B 71/022; A63B 71/04
See application file for complete search history.

(56) References Cited

U.S. PATENT DOCUMENTS 3,593,997 A * 7/1971 Boehner ..... A63B 71/022 135/120.4
5,007,645 A * 4/1991 Weigl ..... A63B 63/00 273/407
5,062,646 A 11/1991 Crist
5,116,056 A * 5/1992 Schmutte ..... A63B 63/00 160/330
5,178,384 A 1/1993 Gorman
6,283,876 B1 * 9/2001 Northcutt ..... A63B 47/002 473/422
6,379,272 B1 * 4/2002 Gorgo ..... A63B 71/022 273/407
6,482,112 B1 11/2002 Betz
6,485,373 B1 * 11/2002 Stephens ..... A63B 63/00 473/162
2015/0051023 A1 * 2/2015 Aipperspach ..... A63B 69/0071 473/433

* cited by examiner

*Primary Examiner* — Raleigh W Chiu
(74) *Attorney, Agent, or Firm* — Plager Schack LLP

(57) ABSTRACT

A net deployment system is adapted to deploying a net around a desired area having a wall adjacent to a floor. The net deployment system has a first swing arm, pivotally attached to the wall and further attached to the wall with a first support cable. A second swing arm is pivotally attached to the wall and further attached to the wall with a second support cable. A plurality of net support cables join the first swing arm and the second swing arm. A net storage bag is attached to the first swing arm with a first frame cable. A second frame cable is attached to the first frame cable and further attached to the wall between the first frame cable and the second frame cable. A net is housed in the bag and connected to the plurality of set support cables. Pulling the first swing arm away from the wall by rotating the second swing arm lowers the net storage bag toward the floor and deploys the net.

4 Claims, 7 Drawing Sheets

NET DEPLOYMENT SYSTEM

RELATED APPLICATION

This application claims priority to provisional patent application U.S. Ser. No. 62/043,165 filed on Aug. 28, 2014, the entire contents of which is herein incorporated by reference.

BACKGROUND

The embodiments herein relate generally to systems that deploy nets. Prior to embodiments of the disclosed invention net deployment systems took up a substantial amount of space and did not allow for rapid deployment. Some other efforts in the field include: U.S. Pat. No. 6,482,112 issued to Betz; U.S. Pat. No. 5,178,384 issued to Gorman; and U.S. Pat. No. 5,062,646 issued to Crist. None of these endeavors deal with segregated storage of the net against a wall. Embodiments of the disclosed invention solve that problem.

SUMMARY

A net deployment system is adapted to deploying a net around a desired area having a wall adjacent to a floor. The net deployment system has a first swing arm, pivotally attached to the wall and further attached to the wall with a first support cable. A second swing arm is pivotally attached to the wall and further attached to the wall with a second support cable. A plurality of net support cables join the first swing arm and the second swing arm. A net storage bag is attached to the first swing arm with a first frame cable. A second frame cable is attached to the first frame cable and further attached to the wall between the first frame cable and the second frame cable. A net is housed in the bag and connected to the plurality of set support cables. Pulling the first swing arm away from the wall by rotating the second swing arm lowers the net storage bag toward the floor and deploys the net.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
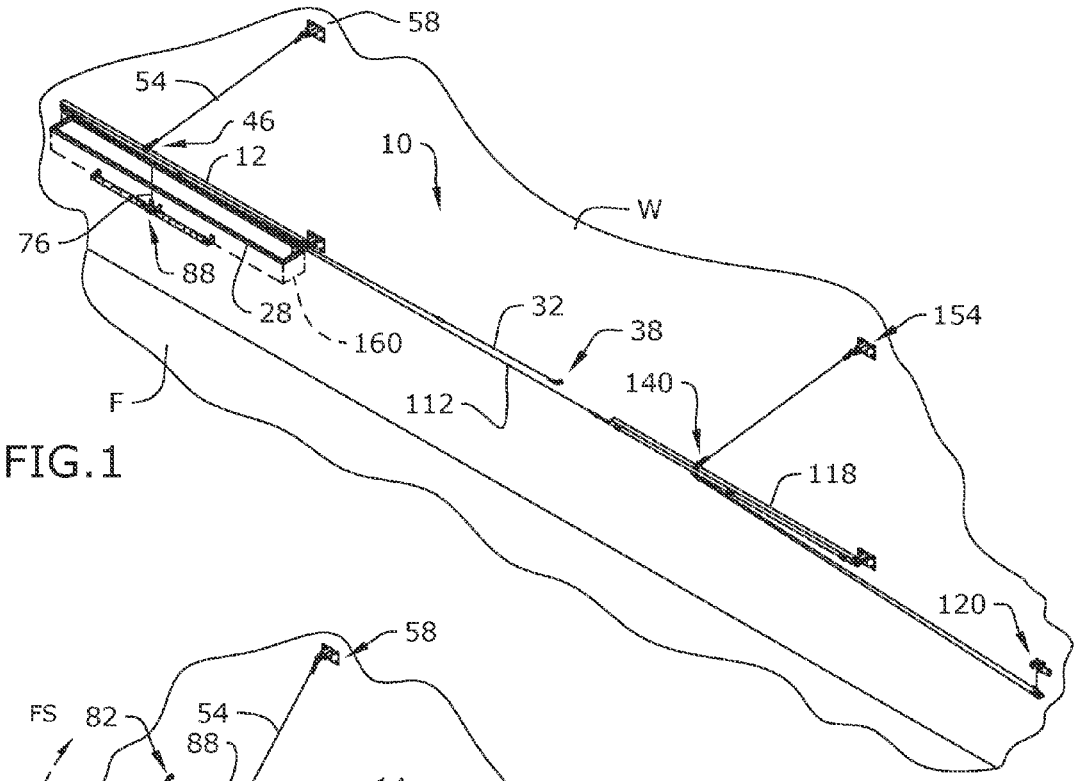
FIG. 1 is a perspective view demonstrating an embodiment of the invention in non-extended state.

By way of example, and referring to FIGS. 1-4, wall W is attached to Floor F at a right angle as is common in the construction of structures. Wall W is attached to net deployment system 10. Net deployment system 10 comprises first arm 12 pivotally attached to wall W. First arm 12 is supported from wall W with first arm support cable 54. First arm 12 is connected to second arm 118 with a plurality of net support cables 112. Second arm 118 is pivotally attached to wall W in the same manner as first arm 12. Further, second arm 118 is supported from wall W with second arm support cable 148. When the plurality of net support cables 112 are taut rotating the first arm 12 will necessarily move second arm 118 as long as the plurality of net support cables 112 remain taut.

Net deployment system 10 is designed so that the plurality of net support cables 112 remain taut. In the first instance, torsion spring assembly 88 is tethered to first arm 12 with torsion cable 76. This applies spring force Fs onto first arm 12 rotating the first arm 12 clockwise toward wall W. In the absence of an intervening force to the contrary, torsion spring assembly 88 will draw the net deployment system 10 against wall W as shown in FIG. 1.

Figure 2:
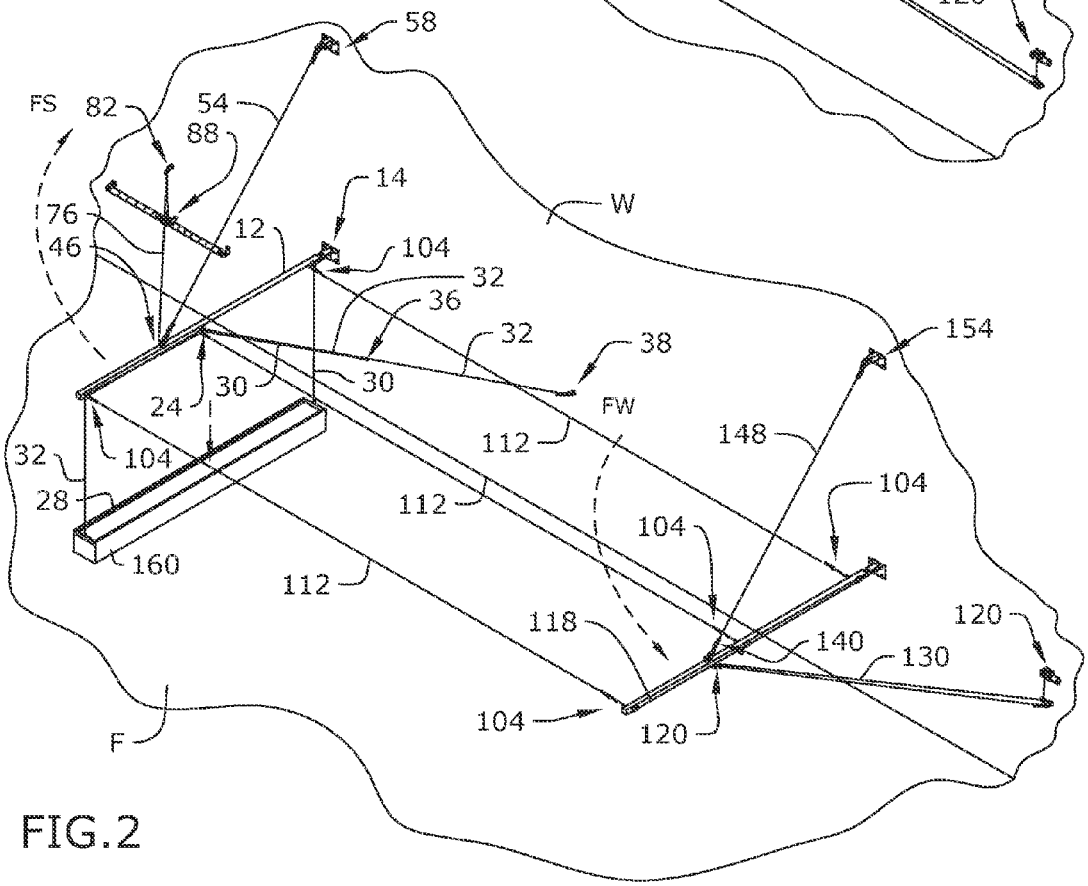
FIG. 2 is a perspective view of an embodiment of the invention shown in extended state and omitting net component for illustrative clarity.
Figure 3:
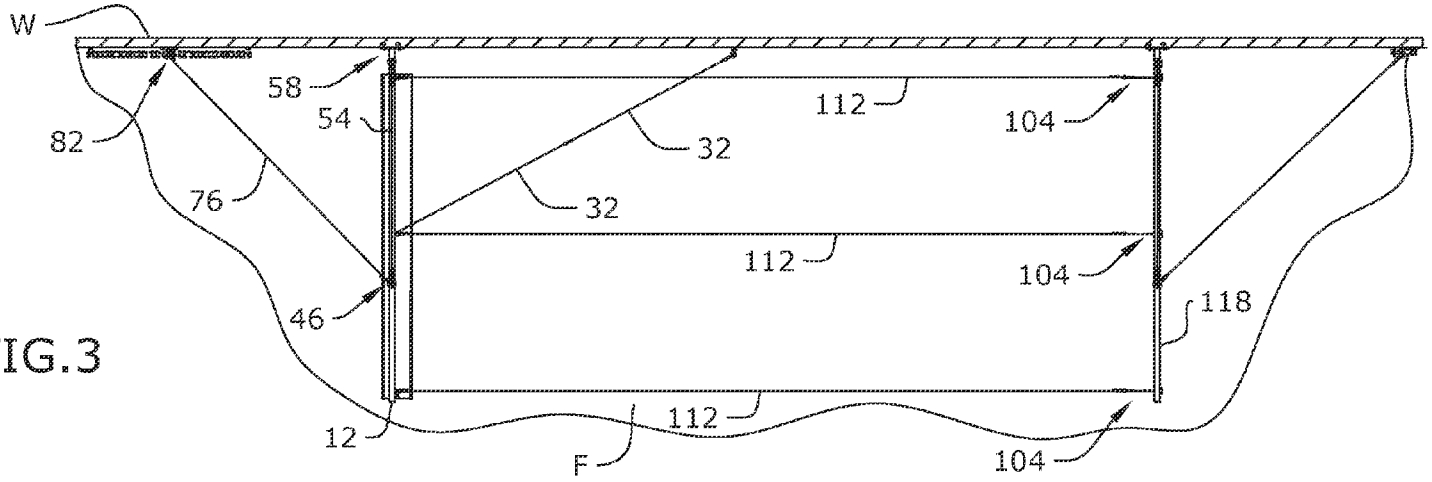
FIG. 3 is a top view of an embodiment of the invention shown in extended state and omitting net component for illustrative clarity.
Figure 4:
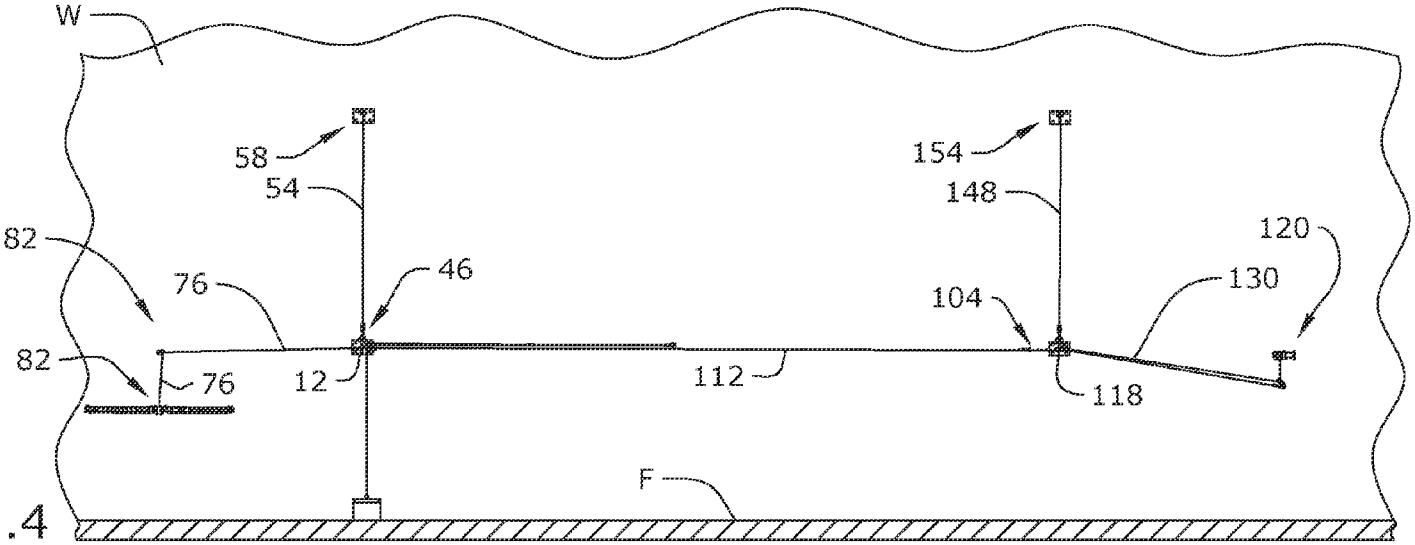
FIG. 4 is a front view of an embodiment of the invention shown in extended state and omitting net component for illustrative clarity.

The force to the contrary is caused by winch assembly 120. Winch assembly 120 is connected to second arm 118 with winch cable 130. This creates winch force Fw which rotates second arm 118 counterclockwise away from wall W. This pulls first arm 12 away from wall W and, in some embodiments, perpendicular to wall W as shown in FIGS. 2-4.

Another feature of net deployment system 10 is the ability to deploy the net 158, which is not shown for illustrative clarity in FIGS. 1-4. Net 158 is housed in net storage bag 160 which has net storage bag frame 28. Net storage bag frame 28 is attached to first frame cable 30 in two places. First frame cable 30 is attached to second frame cable 32 which is then attached to wall W approximately between first arm 12 and second arm 118. When spring force Fs pulls first arm 12 toward wall W, net storage bag 160 is pulled upward proximate first arm 12 because the length of the first frame cable 30 is redirected against wall W instead of below first arm 12.

Figure 5:
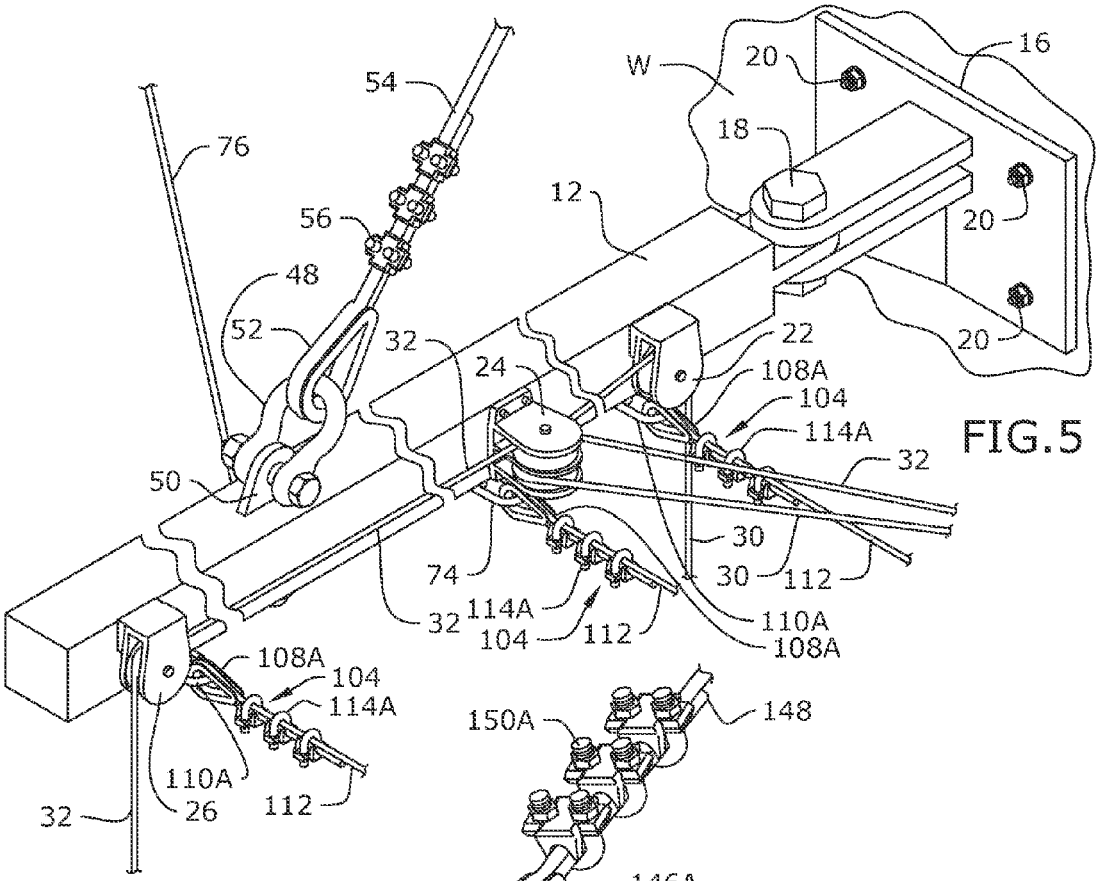
FIG. 5 is a detail top right perspective view of the left arm.

As shown in FIG. 5, wall hinge system 14 further comprises wall bracket 16 attached to first arm 12 with first arm pivot joint 18. Wall bracket 16 is attached to wall W with a plurality of wall anchors 20. In some embodiments four wall anchors 20 can be used.

Figure 9:
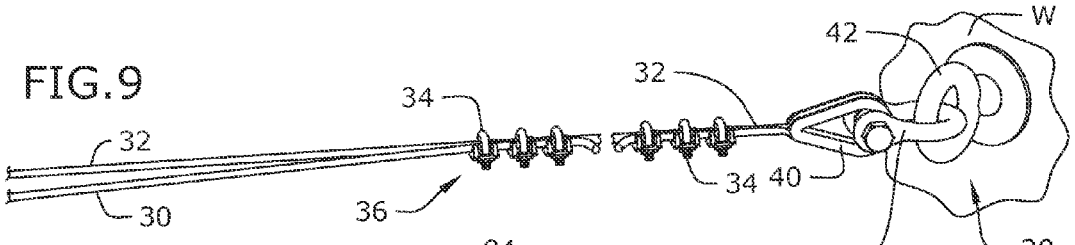
FIG. 9 is a detail right perspective view of the invention.

First arm 12 is further attached to first vertical pulley 22, first horizontal pulley 24 and second vertical pulley 26. A first end of net storage bag frame 28 is attached to first frame cable 30. As shown in FIG. 9, first frame cable 30 travels through first vertical pulley 22 and first horizontal pulley 24. After that first frame cable 30 is fused to second frame cable 32 with a plurality of cable links 34 at doubling point 36.

From there, second frame cable 32 is attached to wall W with second frame cable wall attachment system 38. Second frame cable wall attachment system 38 comprises cable thimble 40 attached to second frame cable 32. Cable thimble 40 is attached to wall eyebolt 42 with shackle 44.

From there, second frame cable 32 passes back through horizontal pulley 24 and parallel to first arm 12. After that, second frame cable 32 passes through second vertical pulley 26 and is attached to a second end of net storage bag frame 28.

First arm 12 is attached to first arm support system 46. First arm support system 46 further comprises first arm support shackle 48 attached to first arm 12 with first arm support ear 50. First arm support shackle 48 is further connected to first arm cable thimble 52. First arm support cable 54 is wrapped around first arm cable thimble 52 and attached to itself with a plurality of first arm support cable clamps 56.

Figure 7:
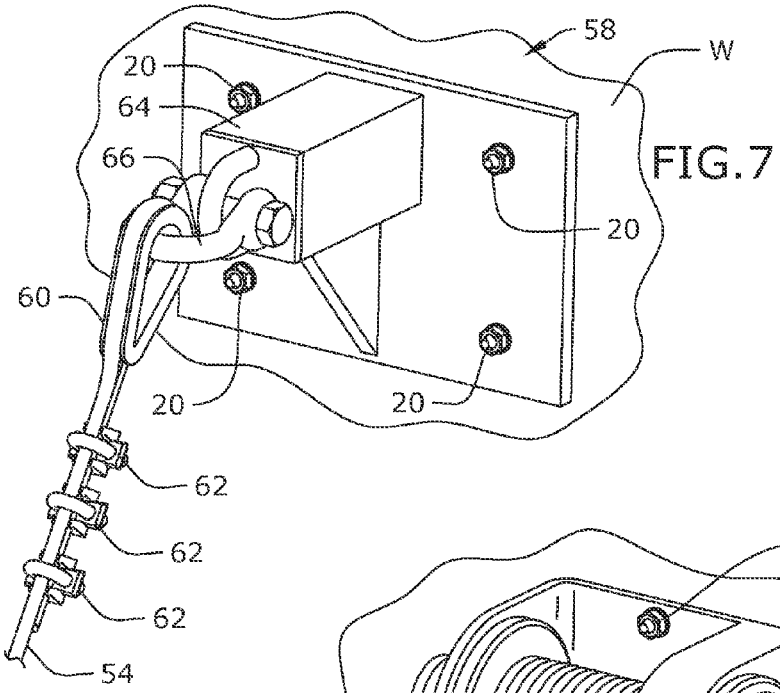
FIG. 7 is a detail top right perspective view of the cable support.
Figure 8:
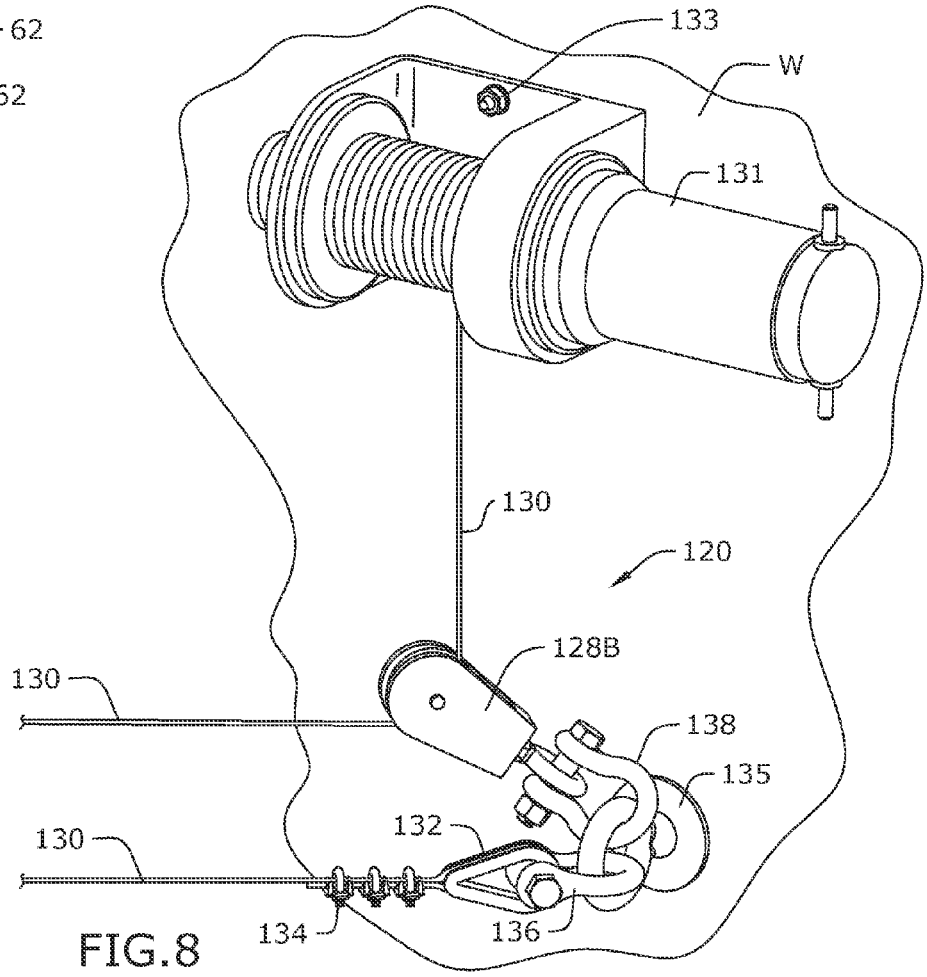
FIG. 8 is a detail top right perspective view of the winch mechanism.

FIG. 7 shows the opposite end of first arm support cable 54. First arm support cable 54 is attached to first arm support cable wall assembly 58. First arm support cable 54 is wrapped around first arm wall thimble 60 and attached to itself with a plurality of first arm wall cable clamps 62. First arm wall thimble 60 is attached to first arm upper cable stay bracket 64 with first arm upper cable stay bracket shackle 66. First arm upper cable stay bracket 64 is attached to wall W with a plurality of wall anchors 20.

Figure 11:
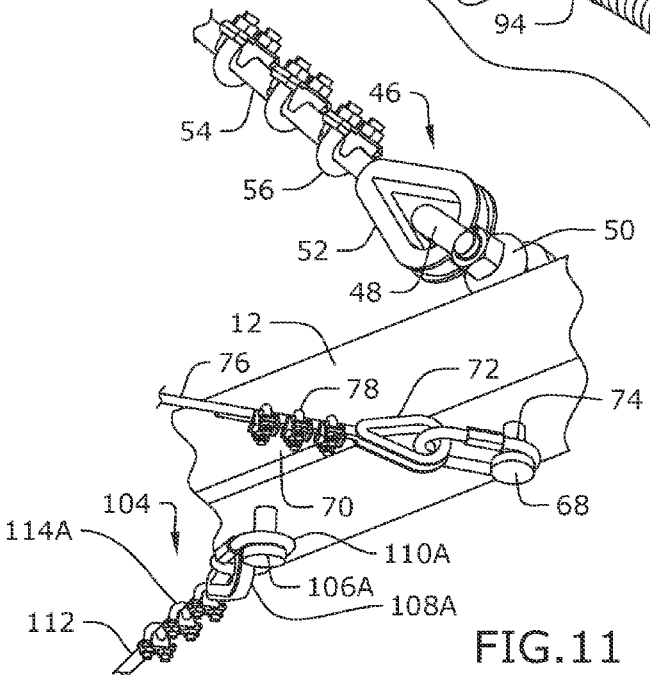
FIG. 11 is a lower left side detail perspective view of an embodiment of the invention first arm.

As shown in FIG. 11, first arm 12 is attached to underarm post 68. Underarm post 68 is attached to torsion cable assembly 70. Torsion cable assembly 70 comprises torsion cable thimble 72 attached to underarm post 68 with quick connect 74. Torsion cable 76 is wrapped around torsion cable thimble 72 and attached to itself with a plurality of torsion cable clamps 78.

Figure 10:
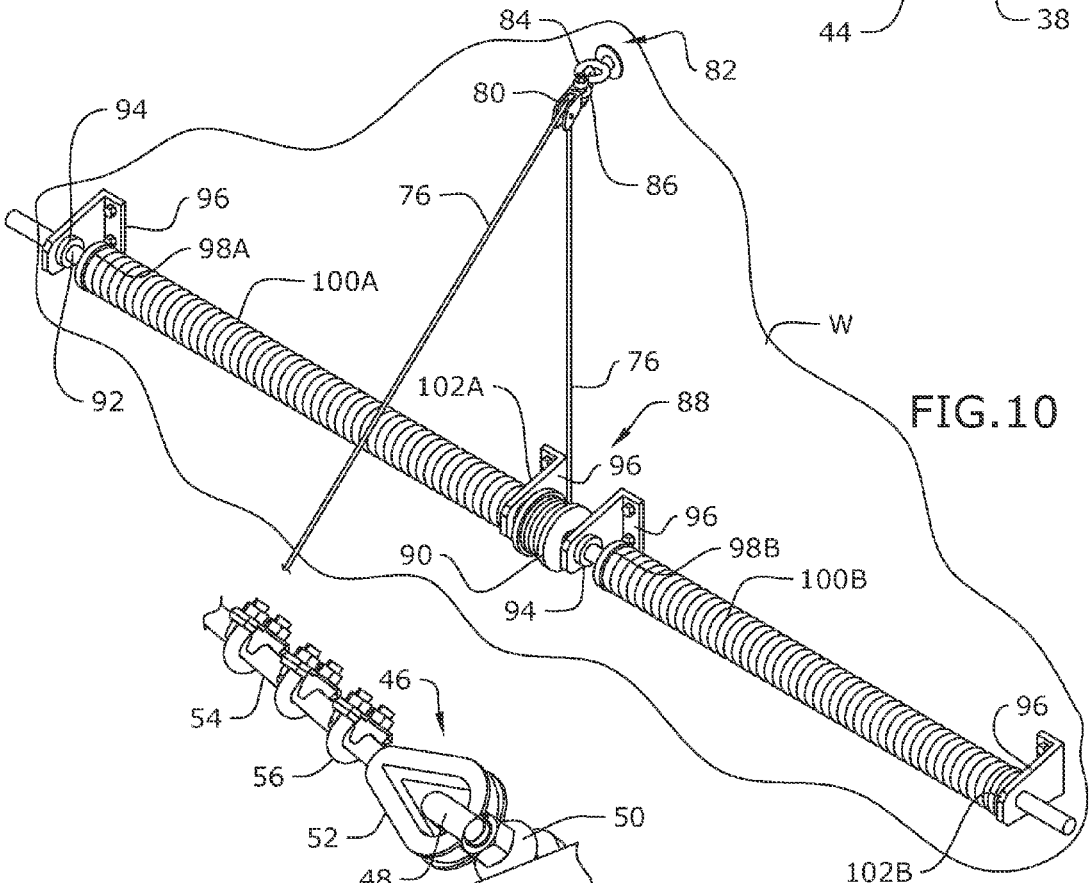
FIG. 10 is a detail top right perspective view of an embodiment of the invention torsion spring mechanism.

Turning to FIG. 10, torsion cable 76 is wrapped around torsion cable pulley 80. Torsion cable pulley 80 is attached to wall W with torsion cable wall attachment assembly 82. Torsion cable wall attachment assembly 82 further comprises torsion cable eyebolt 84 attached to wall W. Torsion cable eyebolt 84 is further attached to torsion cable pulley 80 with torsion cable shackle 86. From there, torsion cable 76 is attached to torsion spring assembly 88. Torsion spring assembly 88 further comprises spindle 90, which is adapted to coil the torsion cable 76. Spindle 90 is rigidly attached to torsion tube 92. Torsion tube 92 passes through a plurality of torsion tube bearings 94. Each torsion tube bearing 94 is attached to a torsion spring connection bracket 96. Each torsion spring connection bracket 96 is attached to wall W.

Torsion tube 92 is attached to first torsion spring winding cone 98A which is further connected to first torsion spring 100A. First torsion spring 100A is further attached to first torsion spring stationary cone 102A. Rotating the first torsion spring winding cone 98A and then fixing the first torsion spring winding cone 98A to first torsion spring 100A creates a torsion spring force onto torsion tube 92. Similarly, torsion tube 92 is attached to second torsion spring winding cone 98B which is further connected to second torsion spring 100B. Second torsion spring 100B is further attached to second torsion spring stationary cone 102B. Rotating the second torsion spring winding cone 98B and then fixing the second torsion spring winding cone 98B to second torsion spring 100B creates a torsion spring force onto torsion tube 92.

First arm 12 is further attached to a plurality of net support assemblies 104. Starting in FIG. 11, each net support assembly 104 further comprises first arm net support underarm post 106A attached to first arm 12. First arm net support underarm post 106A is attached to first net support cable thimble 108A with first net support quick connect 110A. Net support cable 112 is wrapped around net support cable thimble 108A and attached to itself with a first plurality of net support cable clips 114A.

Figure 6:
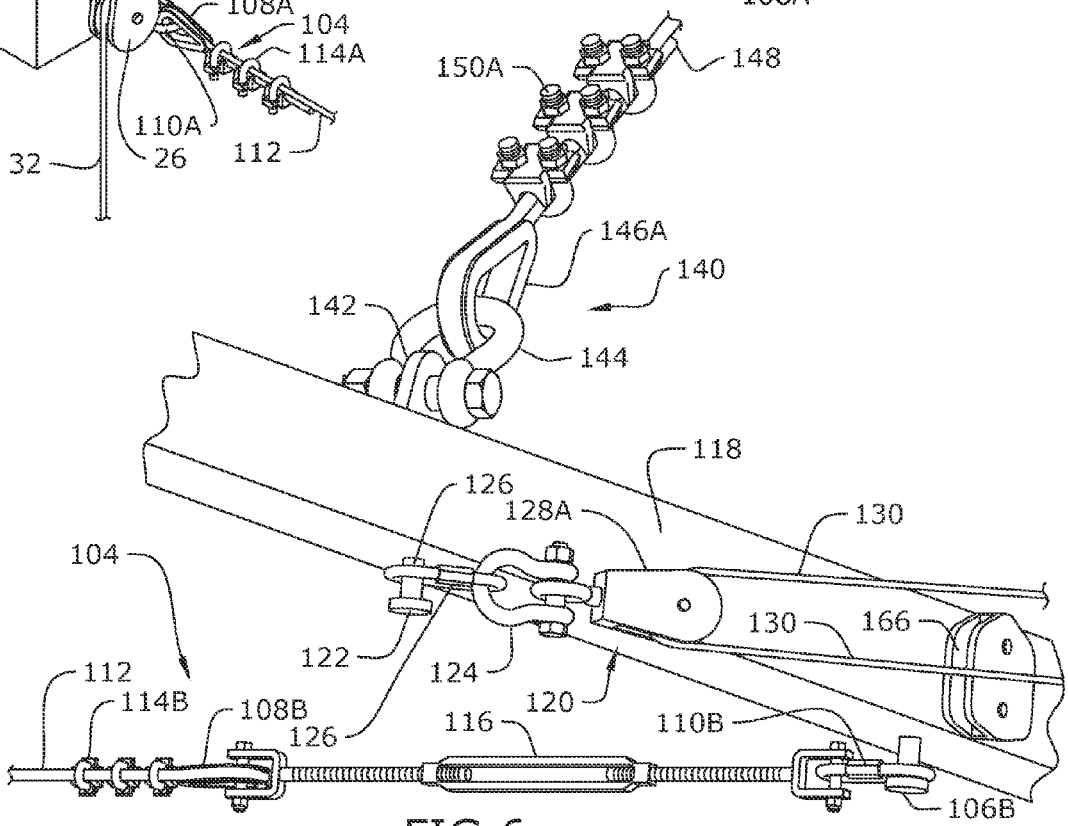
FIG. 6 is a detail lower right perspective of the right arm.

Now transitioning to FIG. 6, net support cable 112 is wrapped around to second net support cable thimble 108B and is then attached to itself with a second plurality of net support cable clips 114B. Second net support cable thimble 108B is connected to turnbuckle 116. Turnbuckle 116 is connected to second arm net support underarm post 106B with second net support quick connect 110B.

Second arm net support underarm post 106B is attached to second arm 118. Second arm 118 is attached to winch assembly 120. Winch assembly 120 further comprises second arm winch assembly underarm post 122. Second arm winch assembly underarm post 122 is connected to second arm winch shackle 124 with second arm winch quick connect 126. Second arm winch shackle 124 is connected to first winch eyebolt pulley 128A. First winch eyebolt pulley 128A is operably connected to winch cable 130.

A first end of winch cable 130 is wrapped around winch thimble 132 then attached to itself with a plurality of winch cable clamps 134. Winch cable 130 then passes through first winch eyebolt pulley 128A, back through second winch eyebolt pulley 128B and then to winch 131. Winch 131 is attached to wall W with winch wall anchor 133. Wall W is further attached to winch wall assembly eyebolt 135. Winch wall assembly eyebolt 135 is attached to winch thimble 132 with winch thimble shackle 136. Winch wall assembly eyebolt 135 is attached to second winch eyebolt pulley 128B with second winch eyebolt pulley shackle 138.

Figure 15:
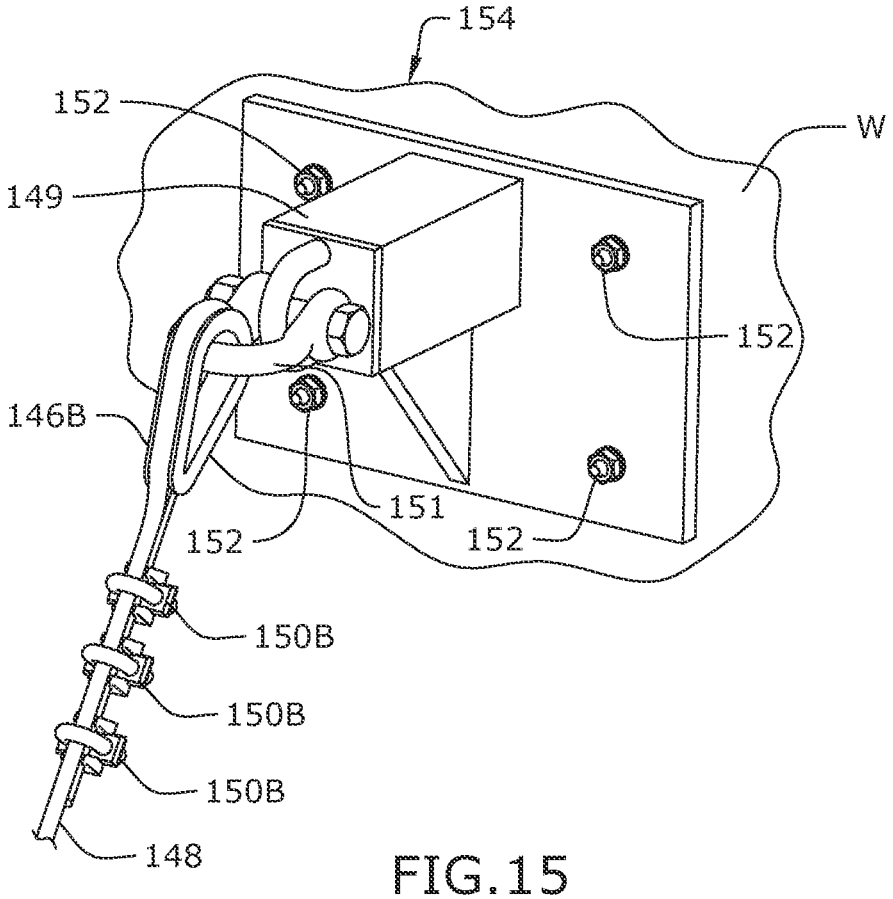
FIG. 15 is a detail perspective view of an embodiment of the invention.

Returning to FIG. 6, second arm 118 is further attached to second arm support system 140 with second arm support ear 142. Second arm support ear 142 is attached to second arm support shackle 144. Second arm support shackle 144 is operably connected to second arm support thimble 146A. Second arm support cable 148 has a first end that is wrapped around second arm support thimble 146A and attached to itself with a plurality of second arm support clips 150A. Turning to FIG. 15, second arm support cable 148 has a second end that is wrapped around second arm second support thimble 146B and attached to itself with a second plurality of second arm support clips 150B.

Second arm second support thimble 146B is attached to second arm upper cable stay bracket 149 with second arm upper cable stay bracket shackle 151. Second arm upper cable stay bracket 149 is attached to wall W with a plurality of wall anchors 152. Collectively, this is second arm wall attachment assembly 154.

Figure 12:
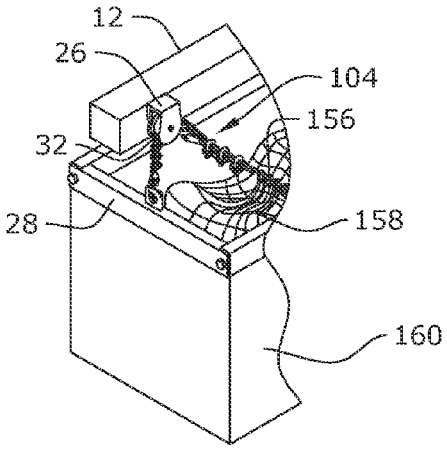
FIG. 12 is a detail perspective view demonstrating net/net-bag in non-extended state.
Figure 13:
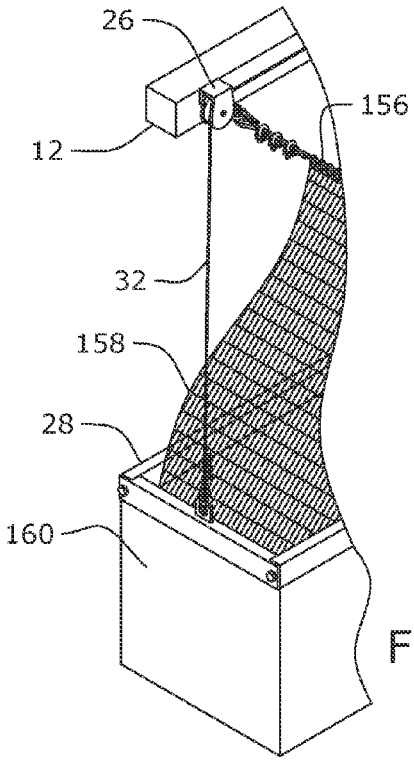
FIG. 13 is a detail perspective view demonstrating net/net-bag in extended state.
Figure 14:
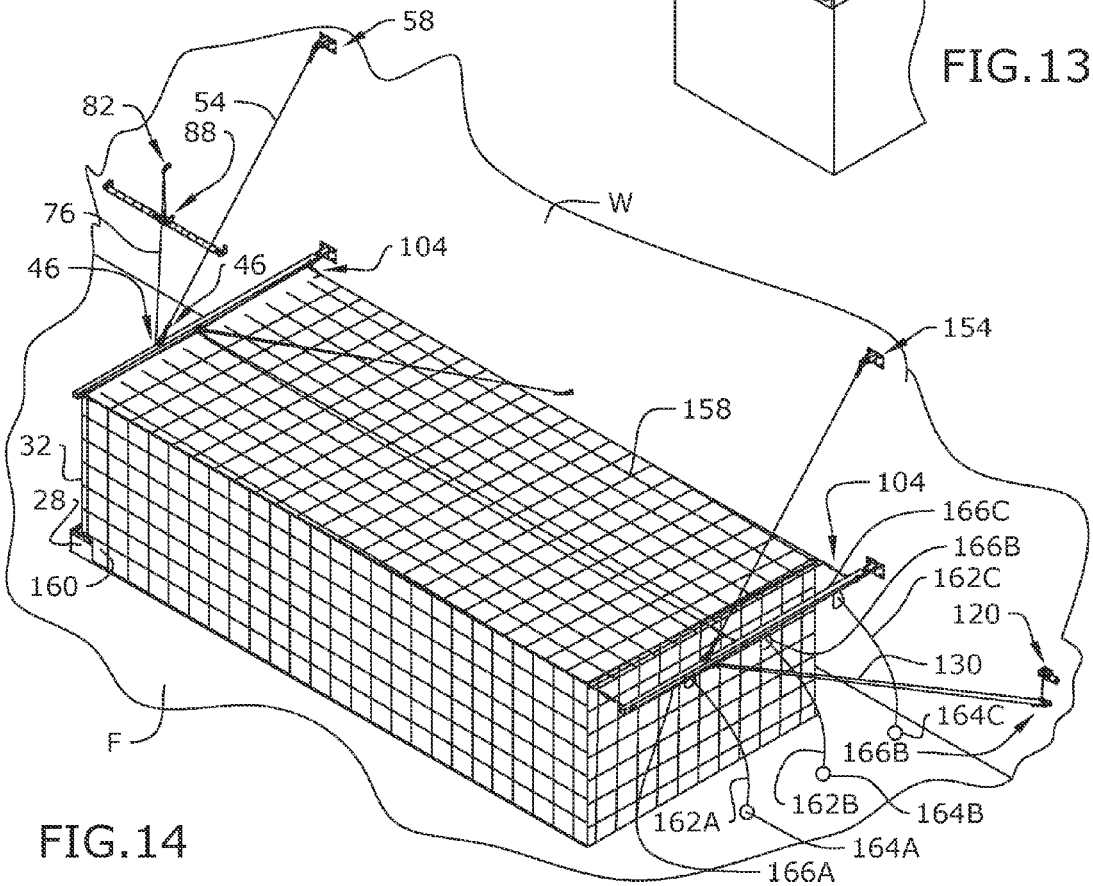
FIG. 14 is a perspective view of an embodiment of the invention shown in extended state with net component.

Turning to FIGS. 12-14, as noted above first arm 12 is mechanically coupled to a plurality of net support assemblies 104. Each net support assembly 104 comprises a net support cable 112. Each net support cable 112 is attached to a plurality of net support rings 156. Each net support ring is attached to net 158. Net 158 fits inside net storage bag 160. Net 158 is further coupled to a plurality of net pull lines 162A, 162B and 162C. Each net pull line terminates with a ball 164A, 164B or 164C. Second arm 118 is attached to a plurality of cleats 166A, 166B and 166C.

A user can manually drag the net 158 across the plurality of net support cables 112 and then throw the first ball 164A over second arm 118 and then tie the first net pull line 162A to first cleat 166A. Next, the user can throw the second ball 164B over second arm 118 and then tie the second net pull line 162B to second cleat 166B. Finally, the user can throw the third ball 164C over second arm 118 and then tie the third net pull line 162C to third cleat 166C.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. §112, ¶6. In particular, any use of "step of" in the claims is not intended to invoke the provision of 35 U.S.C. §112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A net deployment system, adapted to deploying a net around a desired area having a wall adjacent to a floor, the net deployment system comprising:

a first swing arm, to be pivotally attached to the wall and further attached to the wall with a first arm support cable;

a second swing arm, pivotally attached to the wall and further attached to the wall with a second arm support cable;

a plurality of net support cables joining the first swing arm and the second swing arm;

a net storage bag, attached to the first swing arm with a first frame cable;

a second frame cable attached to the first frame cable and to be further attached to the wall between the first swing arm and the second swing arm;

a net, housed in the bag and connected to the plurality of set support cables;

wherein pulling the first swing arm away from the wall by rotating the second swing arm lowers the net storage bag toward the floor and deploys the net.

2. The net deployment system of claim 1, further comprising a torsion cable spring to be attached to the wall and further attached to the first arm with a torsion spring cable, wherein a spring force in the torsion spring pulls the first arm toward the wall causing the net storage bag to rise proximate the first arm.

3. The net deployment system of claim 2, further comprising a winch assembly attached to the second arm with a winch cable, wherein engaging the winch assembly exerts a winch force on the second arm which pulls the first arm away from the wall and lowers the net storage bag toward the floor deploying the net.

4. The net deployment system of claim 3, further comprising:

a first vertical pulley, a first horizontal pulley and a second vertical pulley, attached to the first arm;

wherein the first frame cable attached to a first end of the net storage bag frame that is attached to the net storage bag;

wherein the first frame cable travels through the first horizontal pulley and the first vertical pulley before being attached to a second frame cable;

wherein the second frame cable travels through the first vertical pulley and the second horizontal pulley before being attached to a second end of the net storage bag; and a second frame cable wall attachment system, connected to the second frame cable and configured to be connected to the wall.

* * * * *